United States Patent [19]

Gross et al.

[11] 4,262,593

[45] Apr. 21, 1981

[54] PRINTING APPARATUS

[76] Inventors: Henry Gross, "Braewood", 45 Winnington Rd.; Samuel Gross, "Springcroft", 43 Winnington Rd., both of London, England

[21] Appl. No.: 74,453

[22] Filed: Sep. 11, 1979

Related U.S. Application Data

[63] Continuation of Ser. No. 923,506, Jul. 10, 1978, abandoned.

[30] Foreign Application Priority Data

Jul. 29, 1977 [GB] United Kingdom ..... 31995/77

[51] Int. Cl.[3] ..... B41J 3/42

[52] U.S. Cl. ..... 101/99; 101/93.11; 101/90

[58] Field of Search ..... 101/93.11, 93.22, 93.08, 101/95, 99, 110, 93.38, 93.39, 93.40, 90

[56] References Cited

U.S. PATENT DOCUMENTS

| | | | |
|---|---|---|---|
| 3,033,107 | 5/1962 | Hanley | 101/110 |
| 3,415,184 | 12/1968 | Perucca | 101/93.27 |
| 3,728,961 | 4/1973 | Gross et al. | 101/99 |
| 3,814,010 | 6/1974 | Stanchev et al. | 101/90 |
| 3,828,664 | 8/1974 | Dikoff | 101/110 X |
| 3,884,144 | 5/1975 | Shimodaira | 101/99 |
| 4,084,507 | 4/1978 | Sato | 101/110 |

FOREIGN PATENT DOCUMENTS

| | | | |
|---|---|---|---|
| 2318117 | 11/1973 | Fed. Rep. of Germany | 101/99 |

*Primary Examiner*—Edward M. Coven
*Attorney, Agent, or Firm*—James C. Wray

[57] ABSTRACT

A printing apparatus especially for a cash register has printing wheels mounted on a shaft with a spring pressed friction detent means between the shaft and each wheel so that the wheels are positively driven but can overrun the detent means when they are stopped in their printing positions while having residual frictional engagement; the shaft rotating through only a part revolution then remaining stationary during printing and finally driving in rotating through only a part revolution then remaining stationary during printing and reverse to return the wheels to their starting positions.

3 Claims, 3 Drawing Figures

PRINTING APPARATUS

This is a continuation of Ser. No. 923,506 filed July 10, 1978, now abandoned.

This invention relates to printing apparatus and its main object is to provide an apparatus which can be readily applied to any apparatus which gives out results in the form of electrical pulses. The invention is especially intended for cash registers and data terminals which require a printed audit roll and printed tickets for the customers. However, the invention can also be used for purposes requiring only a single printing at each operation. Various forms of such printing apparatus have been made but involve a relatively large number of parts and a more particular object of this invention is to provide such a printing apparatus which has a simplified and less costly construction involving a reduced number of parts. Another object of the invention is to militate against faulty operation giving rise to errors in the printing result.

According to the invention we provide a printing apparatus comprising a series of printing wheels each of which carries at least two sets of similar printing characters on their peripheries, said wheels being mounted on a driving shaft, a series of spring pressed friction detent means between the shaft and each wheel respectively, said detent means conveying positive drive from the shaft to the wheels, stop teeth on the wheels, means to stop the wheels in different selected positions by engagement with said teeth, means to print the stationary selected characters off the wheels and means to drive the shaft whereby all the wheels are driven and the detents release from their positive engagement so as to overrun the stopped wheels while providing residual frictional engagement and finally the shaft drives in reverse direction so that the detents resume their positive engagement and drive the wheels to start positions when the stop means are disengaged. The friction detent means may for example be steel balls carried either by the shaft or the wheels. This construction not only involves few and simple parts but ensures that the wheels remain in exact synchronism with each other in their rest positions and during movement between their starting positions and their interrupted positions and precisely synchronised with the movement of the pawls. This avoids the possibility of errors which can occur with printing wheels driven by a rod which passes through arcuate slots in printing wheels, in rod being driven by toothed gears. The rod may become slightly out of alignment with the axis of the printing wheels and the tolerance in the gears can give rise to errors due to entry of pawls into the wrong ratchet teeth.

The pawls may be operated by electromagnets or solenoids and electronic control means of known type.

The shaft may be driven by a member having a pin and slot connection with a lever which is reciprocated once during each cycle of operation.

The printing wheels may each have a small recess in its inner periphery for engagement by the ball.

A constructional form of the invention will now be described by way of example with reference to the accompanying diagrammatic drawings, wherein.

Figure 1:
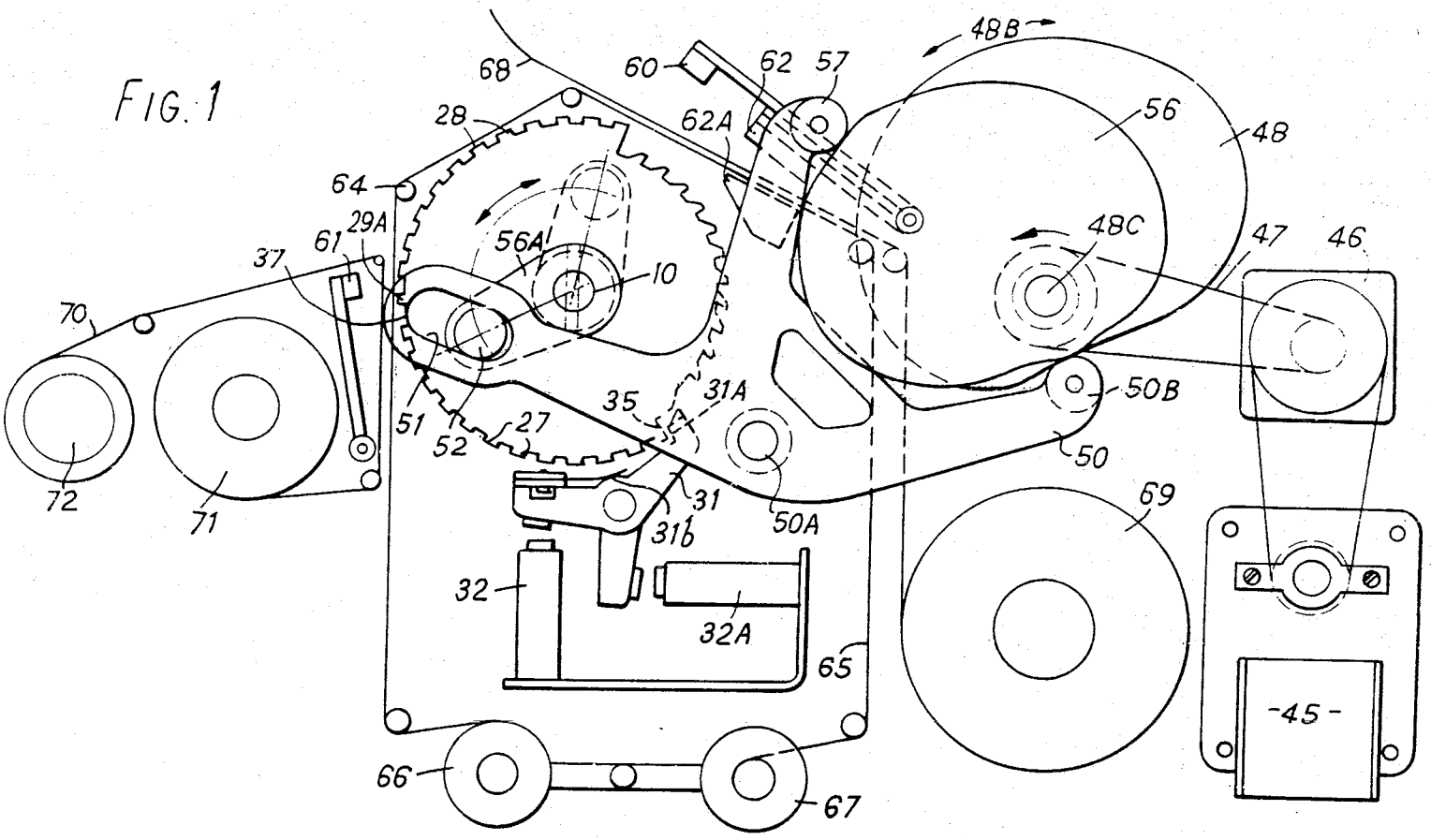
FIG. 1 is a side elevational view of the essential parts of a printing apparatus made in accordance with the invention.
Figure 3:
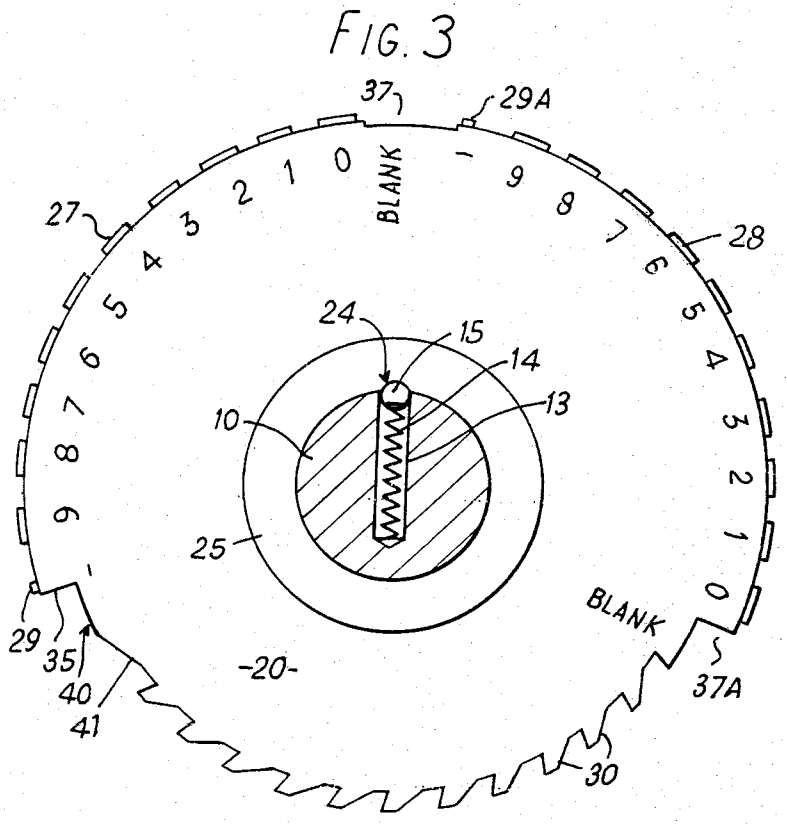
FIG. 3 is an end view partly in section of a print wheel and the print wheel shaft.
Figure 2:
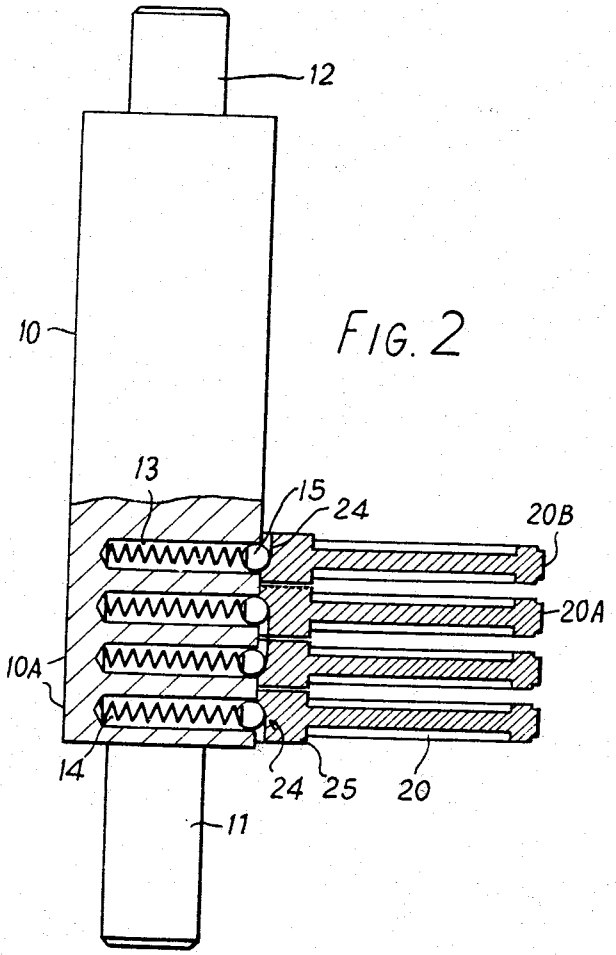
FIG. 2 is a view partly in section of the print wheel shaft shown in end view in FIG. 1 with some of the print wheels.

A shaft 10 has integral end spindles 11, 12 whereby it can be mounted and driven. The shaft 10 is provided with a number of bores 13 which extend radially part way through the shaft and accommodate springs 14 and steel balls 15.

Printing wheels 20 have central bores whereby they are mounted on the shaft 10 in a freely rotatable manner. The inner periphery of each wheel has a small recess 24 engageable by the ball 15 whereby the shaft can drive the wheel through the ball 15.

The wheels at the ends of the shaft may be used for carrying printing words such as "paid out" while the inner wheels may for example carry only numbers 0 to 9.

The wheel 20 may have a boss 25 very slightly thicker than the main part of the wheel. The wheel has two sets of printing characters 0 to 9 at 27, 28 respectively. A hyphen or negative sign may be provided at 29, 29A. The wheel has ratchet teeth 30 for engagement by a pawl 31 operated by an electromagnet 32. The pawl acting on the adjacent wheel is controlled by another electromagnet 32A located at an angle to the electromagnet 32 large enough to allow the electromagnets to be staggered e.g. 90°. Solenoids may be used in place of electromagnets. The wheel has a stop shoulder 35 engageable with a face 31A on the pawl 31 and gaps 37, 37A for use where no printing is required. The wheel is solid and of constant thickness between boss 25 and the printing characters i.e. free from cavities to contain springs or openings to contain wheel moving means—except for any lightening holes or cavities although these are unneccessary and preferably not provided.

The pawl 31 normally seats on a peripheral ledge 40 of the wheel. The diameter of the wheel to the tips of the ratchet teeth is less (e.g. by twenty thousands of an inch) than the radius of the ledge 40 to ensure that the teeth will clear the pawl when the wheel is returning to its zero position and also in the forward direction.

A spring 31B presses on the boss of the pawl 31 to hold it in any position to which it is moved so that when it is positioned by the ledge 40 the pawl will clear the ratchet teeth as these move past the pawl.

Each series of characters occupies nearly one third of the periphery and the ratchet teeth occupy nearly the remaining third.

The ledge 40 is spaced from the first ratchet tooth by a land 41 which is longer than the ratchet teeth to ensure adequate time for the electric motor to achieve a suitable speed able when required for the pawl to engage the first tooth.

The shaft 10 is driven by an electric motor 45 through a reduction gearing 46, belt 47, cam 48 and lever 50 which latter has a pin and slot connection 51, 52 with a crank arm 56A which is pinned on the shaft 10. The lever 50 is mounted on a fixed pivot 50A and carries roll 50B which is held against the cam 48.

The cam 48 has a part 48B (extending over about 40 degrees) which is of constant radius about the axis of the cam shaft 48C so that the wheels are stationary during printing. The initial movement of the cam provides a constant velocity drive for the wheels over a suitable operational angle e.g. 127°. The shaft 10 is thus driven forward to bring the crank arm 56A to the position shown in broken lines in FIG. 1 which is an angular distance slightly greater than that occupied by the teeth 30 and by each set of printing characters. This constant velocity and total movement is also controlled by the cam 56 on the shaft 48C which engages a pin or roll 57 on the lever 50 and which prevents overrun of lever 50.

The wheels are driven in the forward and return directions by the coaxial positively driven shaft 10 through the slipping clutch (in this example the spring pressed ball 15) which engages the interior wheel periphery.

Printing platens 60, 61, 62 are provided and operated in more or less known manner. The platens 60, 61 serve for printing the characters 27, 28 and the platen 62 serves for printing a fixed item such as the name of a shop on a printing block 62A.

The printing ribbon 65 runs on spools 66, 67 and rolls 64. A paper strip 68 is drawn off a spool 69 for the customer's tear-off tickets. A paper strip 70 is drawn off a spool 71 for use as an audit roll and wound on to a spool 72.

The shaft 10 has a continued movement during the commencement of printing to ensure that the wheels are held firmly against the pawls at this time.

Also if desired the wheels may have two sets of ratchet teeth one set being used on each wheel e.g. alternate wheels having pawls acting on different sets of ratchet teeth.

The wheels 20 are made in pairs, the wheels of each pair being different from each other in that one wheel 20A has its recess 24 opened in one axial direction to the surface of the wheel and the recess 24 of the wheel 20B is opened in the other direction. The wheels are spaced from each other only sufficient for clearance e.g. two or three thousandths of an inch. The wheels of each pair can float axially towards each other but the wheels of one pair cannot float towards the wheels of an adjacent pair. It is difficult to make a recess in the bore of a moulded wheel unless the recess opens out in at least one axial direction, but to open it out in in both directions might cause the entire set of wheels to move into contact to build up a friction great enough possibly to prevent driving of any of the wheels by the balls 13.

The wheels are driven forwards and each wheel is stopped at its required position whereupon the associated ball comes out of its positive driving engagement with the depression and then engages the wheel with light frictional engagement and the ball then overruns the wheel to the end of its forward movement. The shaft is then driven in reverse and the balls re-engage the depressions and bring all the wheels back to starting positions in alignment with each other.

We claim:

1. In a printing apparatus comprising a series of printing wheels having printing characters on their peripheries, each said wheel having an axial bore and having a recess opening into said bore and having a series of teeth engageable by pawls, and means to actuate the pawls to stop the wheels when said wheels are moved to their printing positions, said wheels being mounted on a shaft which passes through said respective bore and carries a series of spring pressed detents, each detent being engageable in a recess of a respective printing wheel for driving a wheel, the improvement which consists in that two similar sets of printing characters and one set of said teeth are provided all on the periphery of each said printing wheels whereby the teeth occupy about the same angular circumferential distance as is occupied by each set of said characters, rotary cam means are provided which move to drive the said shaft through a first angular movement of the shaft in a forward direction said angular movement being slightly more than said angular circumferential distance, said actuating means operating during said first angular movement to actuate said pawls to stop said wheels and thereby disengage said detents from said recesses, said cam means have a shape which during continued movement of the cam means holds said shaft stationary, printing means for printing from both sets of characters while said shaft is held stationary, and said cam means have a shape which with further continued movement of the cam means said shaft is driven by the cam means in the reverse direction during which said detents are returned into the recesses.

2. A printing apparatus as claimed in claim 1 wherein the printing wheel shaft is driven from a main shaft by means of a lever driven by the main shaft which has an arm that has a pin and slot connection with a crank arm on said printing wheel shaft.

3. A printing apparatus as claimed in claim 1 wherein the printing wheels are made in pairs, said recesses being formed as depressions which open toward each other at adjacent side surfaces of each pair of wheels.

* * * * *